US006837294B2

(12) United States Patent
Cheng et al.

(10) Patent No.: US 6,837,294 B2
(45) Date of Patent: Jan. 4, 2005

(54) PULL DOWN, PUSH UP, SHADE ASSEMBLY

(75) Inventors: Li-Ming Cheng, Kaohsiung (TW); Lawrence S. Wu, Rowland Heights, CA (US)

(73) Assignee: Zipshade Industrial (B.V.I.) Corp., Ontario, CA (US)

( * ) Notice: Subject to any disclaimer, the term of this patent is extended or adjusted under 35 U.S.C. 154(b) by 0 days.

(21) Appl. No.: 10/623,776

(22) Filed: Jul. 21, 2003

(65) Prior Publication Data

US 2004/0231803 A1 Nov. 25, 2004

Related U.S. Application Data

(63) Continuation-in-part of application No. 10/360,305, filed on Feb. 10, 2003.

(51) Int. Cl.[7] ..... A47H 5/00
(52) U.S. Cl. ..... 160/84.04; 160/170 R
(58) Field of Search ..... 160/170 R, 171 R, 160/168.1 R, 192, 172 R, 84.02, 84.04, 84.05, 84.06, 191, 193; 185/37, 39, 45; 267/155, 156

(56) References Cited

U.S. PATENT DOCUMENTS 1,949,653 A * 3/1934 Moore ..... 160/170
2,267,160 A * 12/1941 McKerlie ..... 248/264
2,572,291 A * 10/1951 Weaver ..... 160/168.1 R
2,594,637 A * 4/1952 Gertzon ..... 160/168.1 R
2,748,852 A * 6/1956 Akerstrom ..... 160/168.1 R
2,759,535 A * 8/1956 Berglind ..... 160/168.1 R
3,798,839 A * 3/1974 Kaufman ..... 49/127
5,482,100 A 1/1996 Kuhar
5,531,257 A 7/1996 Kuhar
5,547,156 A * 8/1996 Djuric ..... 248/307
5,671,793 A * 9/1997 Lee ..... 160/168.1 R
5,799,715 A * 9/1998 Biro et al. ..... 160/170
5,813,447 A 9/1998 Lysyj
6,012,506 A 1/2000 Wang et al.
6,047,759 A 4/2000 Lysyj
6,047,760 A * 4/2000 Judkins ..... 160/168.1 R
6,056,036 A 5/2000 Todd et al.
6,149,094 A * 11/2000 Martin et al. ..... 242/373
6,164,362 A * 12/2000 Yang ..... 160/84.04
6,283,192 B1 * 9/2001 Toti ..... 160/170
6,289,965 B1 9/2001 Ruggles
6,293,329 B1 9/2001 Toti
6,330,899 B1 12/2001 Ciuca et al.
6,474,394 B2 11/2002 Kuhar
6,571,853 B1 * 6/2003 Ciuca et al. ..... 160/192
6,575,223 B1 * 6/2003 Chung et al. ..... 242/378.4
6,681,831 B1 * 1/2004 Cheng et al. ..... 160/84.06

* cited by examiner

*Primary Examiner*—David Purol
(74) *Attorney, Agent, or Firm*—William W. Haefliger

(57) ABSTRACT

A pleated shade assembly capable of height adjustment without use of pull cords, comprising an upper elongated support; a lower elongated member that is manually adjustable up and down; primary lines extending through shade pleats to suspend the bottom elongated member; primary rotors at the top elongated support to entrain the primary lines; at least one secondary line having operative connection to the primary lines; and apparatus acting on the secondary line or lines for counterbalancing suspension force exerted on the primary lines at different shade height adjusted levels including dual rotary members exerting tensioning force on said secondary line or lines, and including a spring coupled to the dual rotary members exerting force tending to entrain the secondary line or lines about the dual rotary members, for storage on at least one of the members.

14 Claims, 7 Drawing Sheets

PULL DOWN, PUSH UP, SHADE ASSEMBLY

This application is a continuation-in-part of prior pending U.S. patent application Ser. No. 10/360,305, filed Feb. 10, 2003.

BACKGROUND OF THE INVENTION

This invention relates generally to window shade control, and more particularly to simplification in raising and lowering pleated window shades without requiring manipulation of a cord or cords hanging downwardly from an upper support or rail member.

The use of hanging cords requiring manual manipulation has been thought to be required for the raising and lowering of window shades, and particularly pleated shades. Such cords are frequently difficult to operate correctly, and their use can result in inaccurate or unwanted shade movement, as well as risk of entanglement with small children, and possible strangulation. There is need for a cordless and pleated window shade assembly which can be easily operated as by simply exerting up or down light force on the lower hanging portion of the assembly.

There is also need for a pleated window shade assembly that is easily operated, and can be automatically kept level, upon adjustment at one location.

SUMMARY OF THE INVENTION

It is a major object of the invention to provide apparatus and method of operation, meeting the above needs. Basically, the invention is embodied in a pleated shade assembly capable of height adjustment without use of pull cords, comprising, in combination:

a) an upper elongated support, b) a lower elongated member that is manually adjustable up and down, c) primary lines extending through shade pleats to suspend said bottom elongated member, d) primary rotors at said top elongated support to entrain said primary lines, e) at least one secondary line having operative connection to said primary lines, f) and means acting on said secondary line or lines for counterbalancing suspension force exerted on said primary lines at different shade height adjusted levels, g) said means including dual rotary members exerting tensioning force on said secondary line or lines, h) said means including a spring coupled to said dual rotary members and exerting force tending to entrain said secondary line or lines about said dual rotary members, for storage on at least one of the members.

It is another object of the invention to provide a spring, as referred to, which has S-shaped configuration, whereby the spring winds in a clockwise direction about one of said members, and in a counterclockwise direction about the other of said members. As will be seen, at least one member has coaxial first and second surface portions, the spring winding about the first portion, and the secondary line winding about the second portion. Typically, each of the members has coaxial first and second surface portions, the spring winding about the first portion and the secondary line or lines winding about the second portion. The spring acts as a shade balancing spring, to hold the shade in any selected vertical position.

Yet another object includes provision of a housing, and posts in the housing supporting the members for free rotation about axes defined by the posts. Annular caps may be associated with the posts and members, for axially positioning the members in the housing. The latter is typically defined by a portion of said upper elongated support which is a shade head rail.

A further object includes the provision of means acting on the above defined secondary line or lines for counterbalancing suspension force exerted on said primary lines at different shade height adjusted levels, said means including a dual rotary member entraining said secondary line, and a spring operatively connected to said dual rotary members. As referred to, that spring may advantageously have S-shaped, flat surface configuration.

It is another object of the invention to provide a rotary member exerting tensioning force on the secondary line or lines; to provide a rotary member exerting tensioning force on that secondary line or lines; and to provide a number of such secondary line or lines less than the number of said primary lines, whereby, the rotary member of small dimension is able to controllably store a maximum number of windings, within the confines of a reduced dimension upper support member, such as a channel configured rail.

It is yet another object of the invention to provide a path of travel for the defined line connection or interconnection, which extends lengthwise of the upper support, and which does not pass over any rotors, and whereby possible derailment of that connection by a rotor is prevented. In this respect, the primary rotors preferably include a first rotor having spacing from said counterbalancing means which exceeds said path of travel, for shade height adjustment between uppermost and lowermost positions.

Further, the primary rotors may typically include at least one second rotor over which said primary lines are entrained, and the primary rotors including a third rotor in the form of a pulley over which one of the primary lines is entrained, and a fourth rotor in the form of a pulley over which another of the primary lines is entrained.

Yet another object includes containment by the upper support of all of the primary rotors and, the tensioning means; the provision of primary lines that have first terminals operatively connected to said lower elongated member, below said upper support; and wherein the primary lines have second terminals operatively connected to said connection, within said upper support.

A further object is to provide a tensioning means that includes a device for locking said secondary line in a selected position or positions corresponding to selected shade height adjustment. In this regard, the secondary line may have an extension that hangs below the level of said device, for manual grasping and control of locking by said device.

An additional object is provision of a fastener or fasteners to attach the upper elongated support to structure above the levels of said rotors and secondary line, said fastener or fasteners being one of the following:

i) a spacer portion to positively locate the elongated support spaced below said structure, ii) a hinged portion to positively locate the elongated support below upright wall to which the hinged portion is attachable.

These and other objects and advantages of the invention, as well as the details of an illustrative embodiment, will be more fully understood from the following specification and drawings, in which:

DRAWING DESCRIPTION

DETAILED DESCRIPTION

Figure 1:
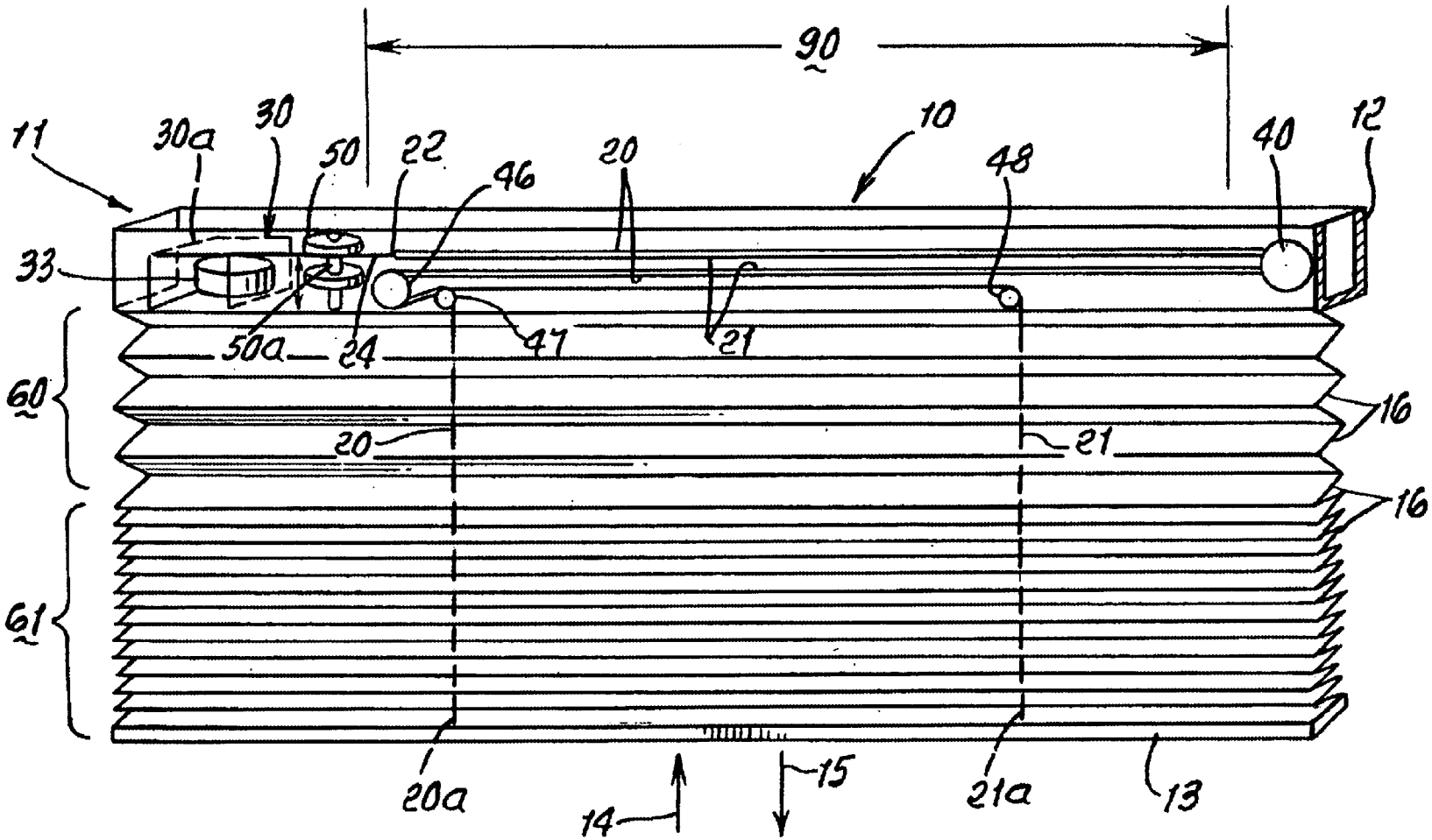
FIG. 1 is an elevational view of an improved shade assembly incorporating the invention.
Figure 3:
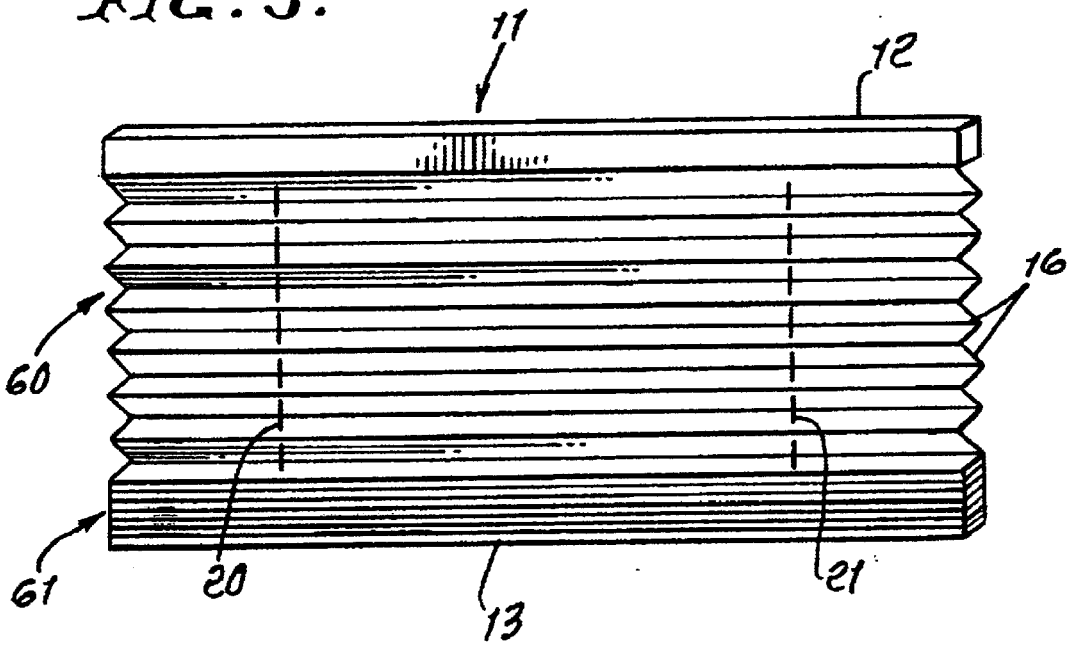
FIG. 3 is a view like FIG. 1, showing the assembly of the invention, no external pull cords being visible.
Figure 2:
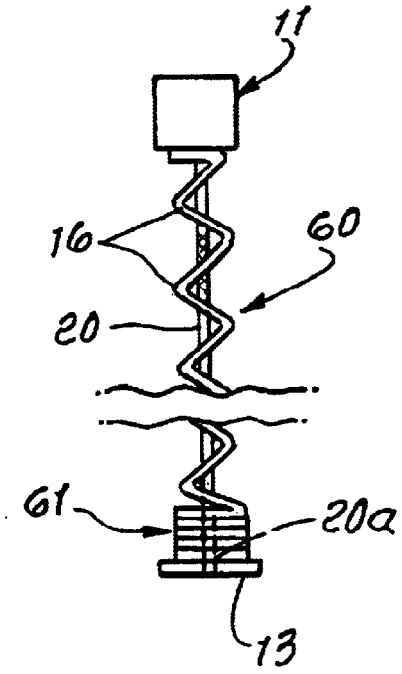
FIG. 2 is an end view of the shade assembly.

In FIGS. 1 and 2, a pleated shade assembly 10 is capable of height adjustment without use of external pull cords. It includes an upper elongated support 11 which may be in the form of a metallic channel or rail 12 which may be otherwise hollow. The assembly also includes a lower elongated slat member 13 that is to be simply manually adjusted up or down, as indicated by arrows 14 and 15. Shade pleats 16 are located between and connected to 12 and 13, as shown. The pleats are foldable, and expand or separate as member 13 is urged downwardly, to selectively adjusted height position, for example controllably covering a window. See for example FIG. 2. The pleats collapse toward one another as the member 13 is elevated toward 12, to another adjusted position or positions. Pleats expand as at 60, from stacked positions as at 61. See also FIG. 2.

Primary lines or cords are provided to extend generally vertically through the pleats, as seen in FIG. 2, to suspend the lower member 13. See for example two lines 20 and 21, connected at their lower ends or terminals 20*a* and 21*a* to member 13, at laterally spaced positions. Two such lines are shown, but three may be provided, as for a larger width shade.

Primary rotors are provided at the upper support or rail 11, to entrain the primary lines, and guide them toward a common connection 22 with at least one secondary line 24 which moves endwise relative to 12 as connection 22 is moved endwise. The number of secondary lines is less than the number of primary lines, for reasons as will appear. Typically, there is only one secondary line 24, and two or more primary lines, such as lines 20 and 21. In that event, connection 22 connects the terminals of lines 20 and 21 with the terminal of line 24, whereby movement of that connection 22 and line 24 in one direction tends to equally raise primary line terminals 20*a* and 21*a*; and movement of connection 22 and line 24 in the opposite direction tends to equally lower primary line terminals 20*a* and 21*a*, the lower member thereby being maintained in horizontal condition as it is raised and lowered.

Figure 4:
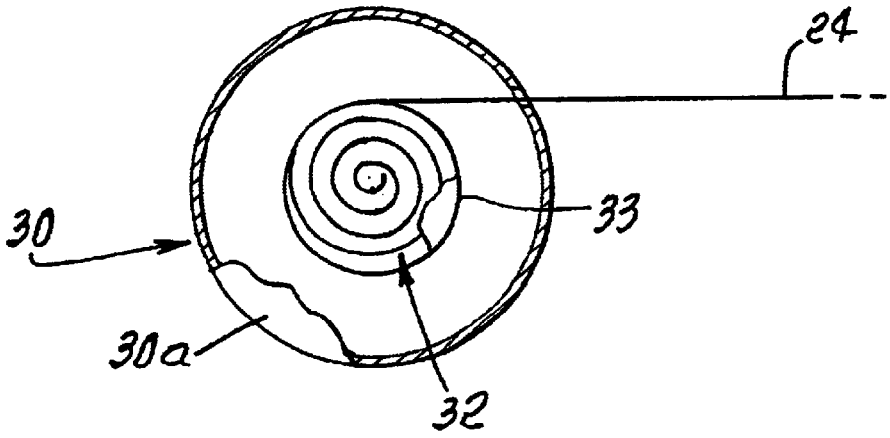
FIG. 4 is a view showing components of a line tensioner means.

Means is provided for acting on the secondary line or lines 24 for exerting force counter-balancing the suspension force exerted on the primary lines, by the weight of the lower member 13, and pleats, as at different shade height adjusted levels. Such counterbalancing force enables stable suspension of the lower member 13 at any vertical position to which it is raised or lowered. Such means is generally indicated at 30 in FIGS. 1 and 4 and may take different forms, but preferably enabling its reception as shown within the confining channel shaped support 11, as near one end thereof. Means 30 may include a housing 30*a*, and a tension exerting torsion spring element 32 within 30*a*. The line 24 is typically wound onto or off a spool or drum 33 within 30*a*, and spring force is exerted on the spool in a line winding direction, to provide the counterbalancing force or tension referred to. That force is maintained as the shade is raised or lowered to stable adjusted position, and static friction may be provided in the means 30 acting to hold the lower member at selected height adjustment. Such friction may be supplied by drum 32 rubbing against the housing. Since only one line 24 is typically spooled at 33, the size of the spool may be minimized to fit within channel 12. A guide pulley 50 directs travel of line 24 to and from the winding area of the spool. Pulley 50 is axially slidable along axle 50*a*, perpendicular to line 24, to follow or guide the line 24 as it is wound on and off drum 33.

In the primary rotor system illustrated a first rotor 40 may have spacing from the tensioning means 30 such that the lengthwise path of travel indicated by dimension 90 of connection 22 does not pass over any primary rotor, or pulleys, such as first rotor 40, thereby eliminating risk of entanglement or "hang-up" of connection 22 with rotor structures. In this regard, first rotor 40 is shown as having spacing from said means 30 which exceeds said path of travel, for shade height adjustment between uppermost and lowermost positions.

As shown, the primary rotors include at least one second rotor over which said primary lines are entrained, and the primary rotors include a third rotor in the form of a pulley over which one of said primary lines is entrained, and a fourth rotor in the form of a pulley over which another of said primary lines (line 21) is entrained.

See for example the following:

second rotor 46, (for example near 50)

third rotor 47 fourth rotor 48.

All of such rotors are contained within the channel shaped support 11. Lines 20 and 21 project downwardly through lower extent of support 11. Rotor 46 is between 50 and 47, so that both lines 20 and 21 may be redirected by like idler rotors 47 and 48, for like vertical control of lines 20 and 21, enhancing maintenance of slat 13 in horizontal condition.

Figure 5:
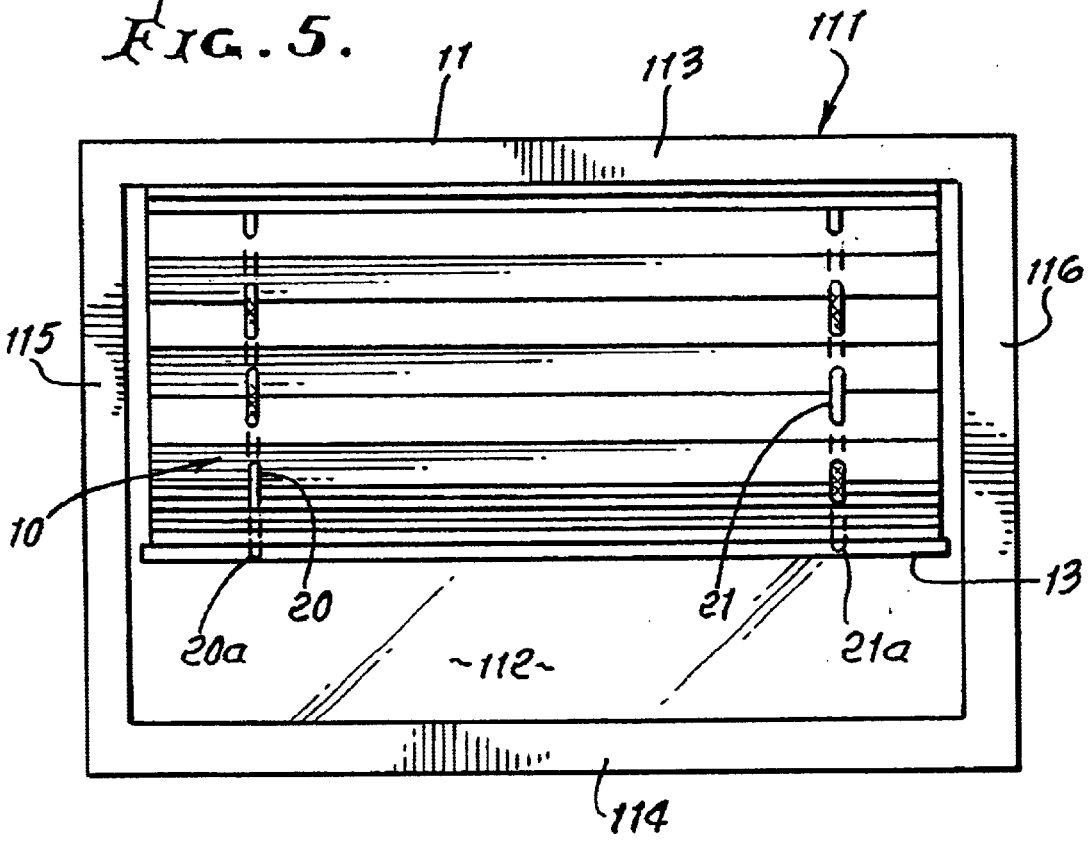
FIG. 5 is an elevation showing a window frame, with the device of the invention located at the window.

In FIG. 5, the assembly or apparatus 10 is installed at a window 112 bordered by a frame 111. The latter has horizontal and vertical frame members 113–116, as shown. Support 11 is attached to upper horizontal frame member 113.

Figure 6:
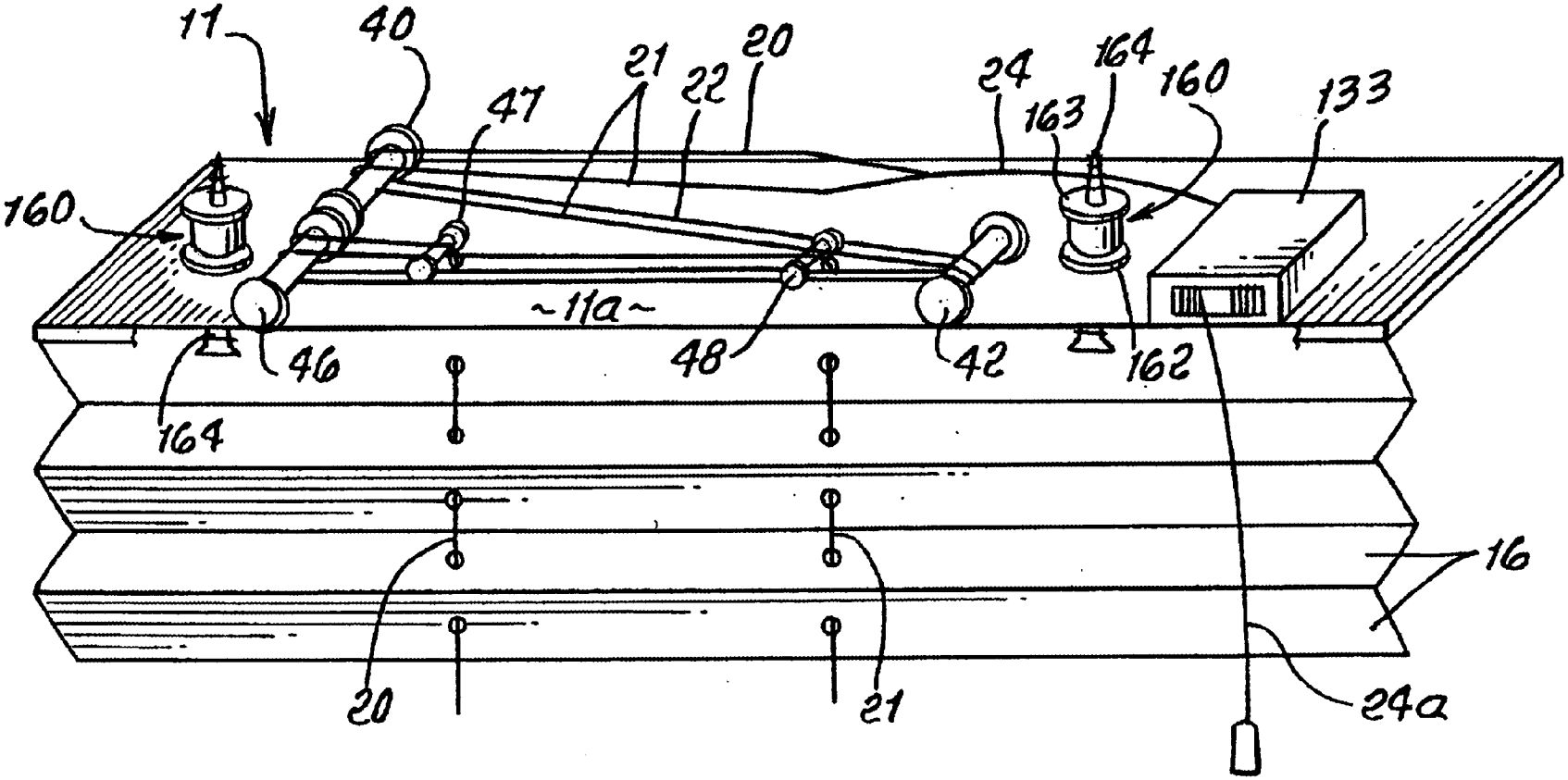
FIG. 6 is a schematic perspective view of a modification.

Referring now to the modification seen in FIG. 6, elements corresponding to elements of FIG. 1 are given corresponding identification numerals. In FIG. 6, rotors 40 and 46 are located at the same general position along 11; and this is enabled by providing an idler rotor 42 carried by 11, and over which primary lines 20 and 21 extend or are entrained, as shown. Idler rollers or rotors 47 and 48 are located along the length of 11, and between 42 and 46.

Secondary line 24 extends to the means 133 acting on 24 for counter-balancing suspension force exerted on the primary lines 20 and 21, as at different shade height adjustment levels. In this instance, the means 133 is a device for locking the secondary line 24 in a selected position or positions corresponding to selected shade height adjustment. In this example, line 24 has an extension 24*a* that hangs below the level of said device, for manual grasping and control of locking by said device. The user can control the locking or unlocking status of means 133 by varying the angularity of pull on single line 24*a*, and thereby control the positions of two lines 20 and 21 that control shade height and bottom level.

In accordance with an additional feature or features of the invention, a fastener or fasteners is or are provided to attach the upper elongated support to structure above the levels of said rotors and secondary line, said fastener or fasteners being one of the following:

i) a spacer portion to positively locate the elongated support spaced below said structure, ii) a hinged portion to positively locate the elongated support below upright wall to which the hinged portion is attachable.

Figure 7:
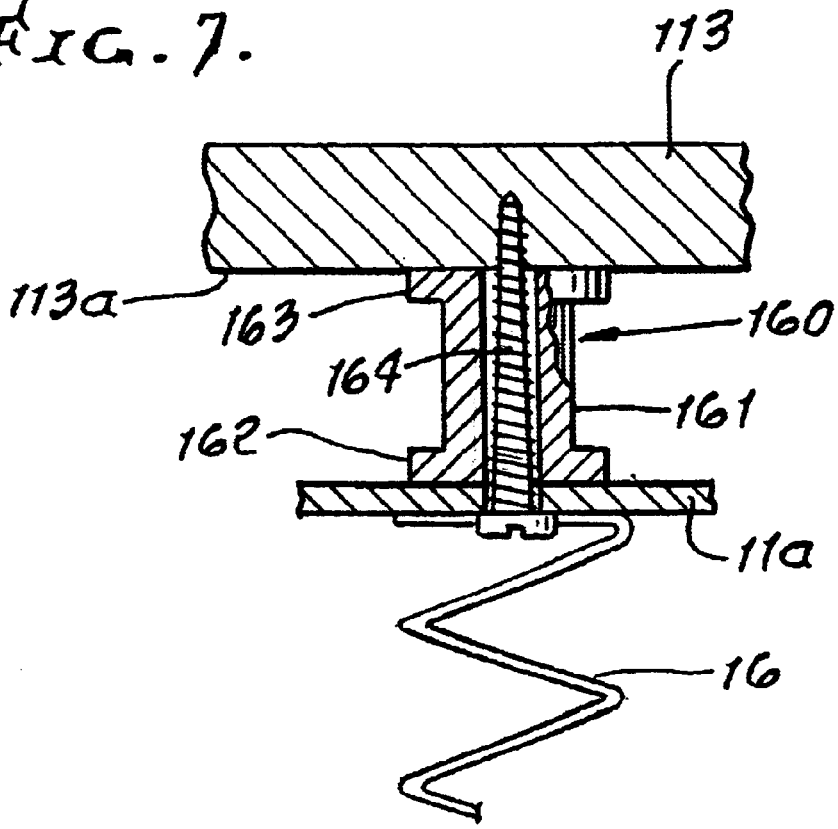
FIG. 7 is an enlarged end view upper extent of the FIG. 6 modification.

FIGS. 6 and 7 show two such fasteners 160 having middle spacer portion 161 to positively locate elongated support lower wall 11*a* at a predetermined fixed distance below the window frame upper member 113. For this purpose, a lower flange 162 on 160 engages lower wall 11*a*, and an upper flange 163 on 160 engages the underside 113*a* of member 113. A retainer screw 164 extends through 160 and connects to 113.

Figure 8:
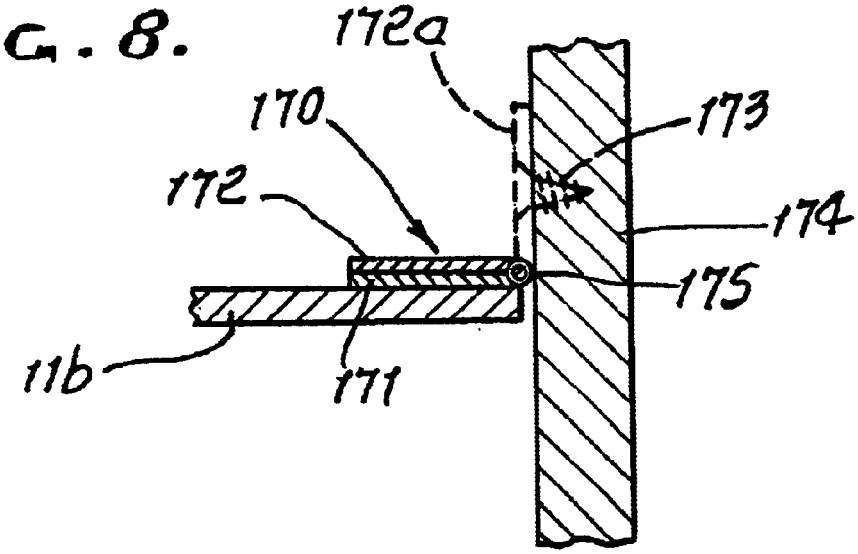
FIG. 8 is an end view of a modified attachment of the upper elongated member of the apparatus, to a wall.

In FIG. 8, the illustrated hinged portion 170 has a first component 171 to attach to the upper wall 11*b* of the elongated support; and a second component 172 to swing upwardly and attach by fastener or fasteners 173 to upright wall 174 on or near the window frame.

Components 171 and 172 are hingedly connected together at 175 to form an L-shaped positive support when 172 is swung upwardly to position 172*a*.

Figure 9:
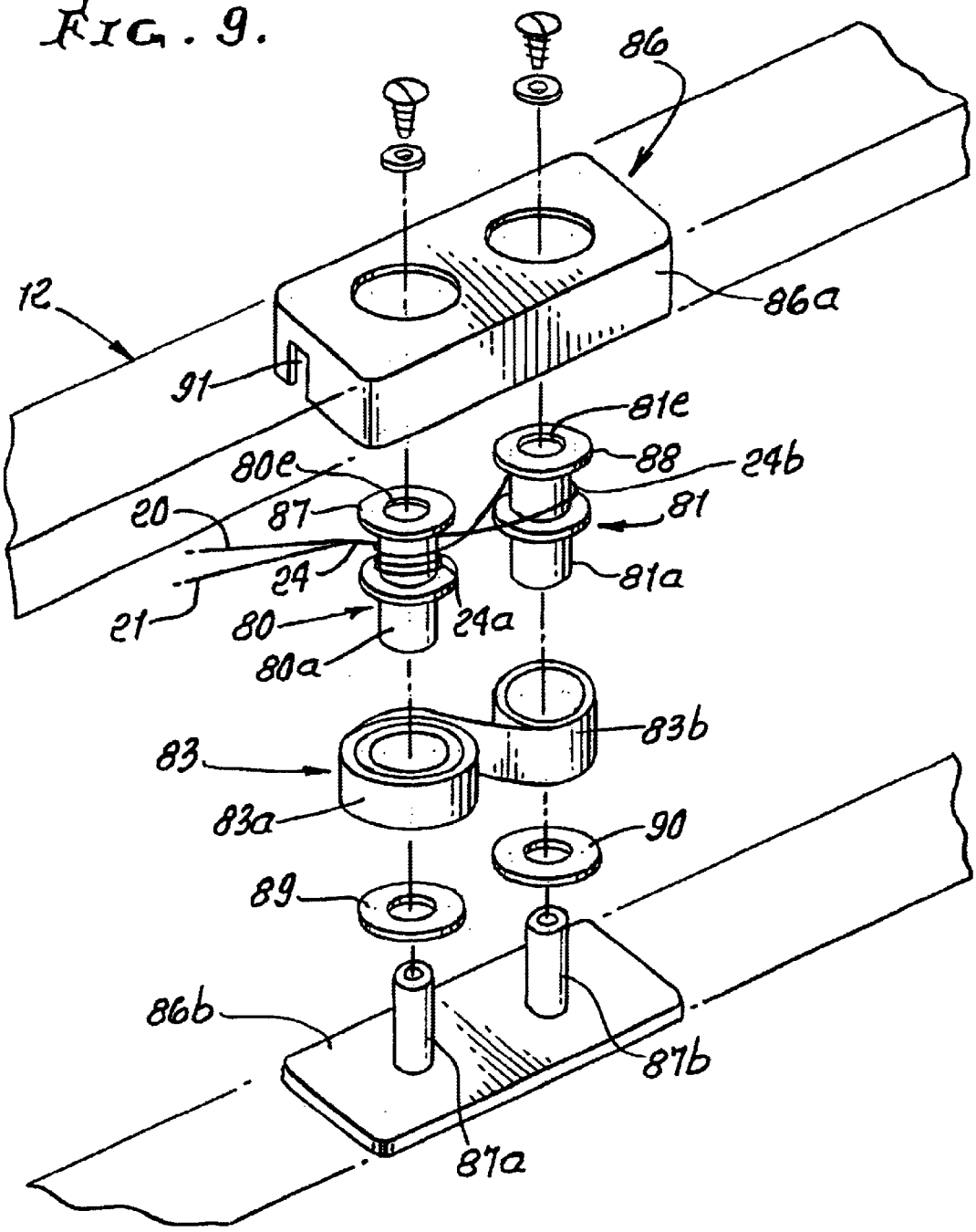
FIG. 9 is an exploded view of a modified cord collector apparatus.
Figure 10:
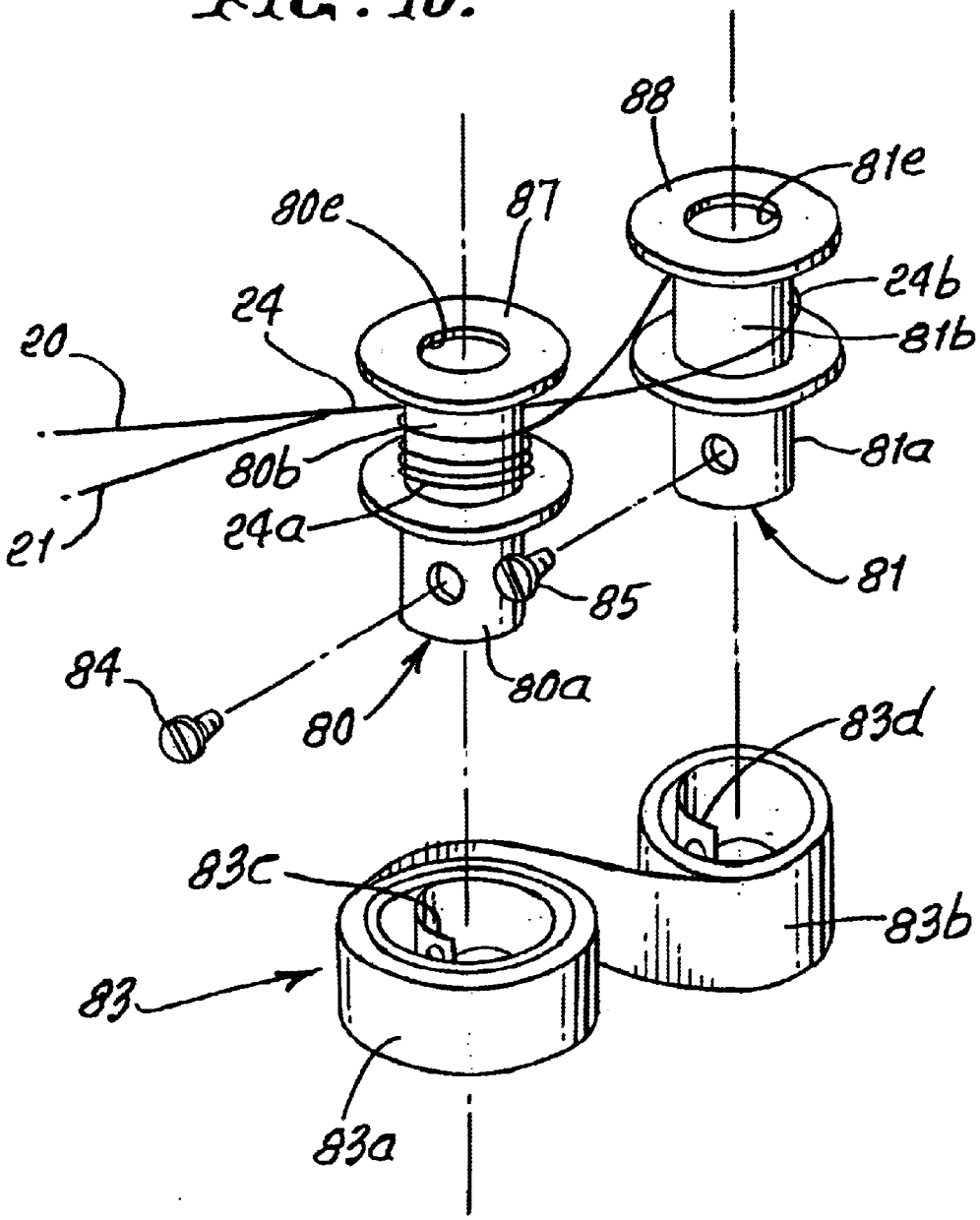
FIG. 10 is an exploded view of a portion of FIG. 9, showing spring attachment to rotary members.

In FIGS. 9 and 10, a modified means is shown acting on the secondary line or lines 24 for counterbalancing suspension force exerted on the primary lines 20 and 21, at different shade height includes dual rotary members 80 and 81 exerting tensioning force on the secondary line 24, that line 24 being entrained or wound about the dual entry members, for line storage, as the shade is raised or lowered.

The referenced counterbalancing means includes a spring coupled to said dual rotary members and exerting force tending to entrain said secondary line or lines about said dual rotary members, for storage on at least one of the members. See for example the spring 83 which has S-shaped configuration, so as to wind or coil at 83*a* in a clockwise direction about a first portion 80*a* of member 80, and so as to wind or coil at 83*b* in a counterclockwise direction about a first portion 81*a* of rotary member 81. The secondary line 24 winds at 24*a* about a second portion 80*b* of the member 80, and at 24*b* about a second portion 81*b* of member 81, as shown. Portions 80*a* and 80*b* are coaxial, and portions 81*a* and 81*b* are coaxial, as shown.

Note in FIG. 10 the attachment of spring end 83*c* to member 80, as for example by means of a fastener or set screw 84; and the attachment of spring end 83*d* to member 81, as by means of fastener or set screw 85. The spring ends may be attached to the two members as by other means, such as bonding, or by spring end turning into grooves in the members.

FIG. 9 also shows a housing 86 that includes a receptacle 86*a* and a cover 86*b*. Posts 87*a* and 87*b* attached to the plate 86*b* extend in parallel relation through bores 80*e* and 81*e* in the rotary members, to mount those members for rotation. Caps 87–90 position the members 80 and 81 and the spring, for endwise back and forth operation of line 24, through opening 91 in 6 the receptacle, with spring tension balancing the weight of the hanging shade, at any selected height position, whereby the shade remains in selected height position. Receptacle 86*a* is typically a part of the head rail 12.

In FIGS. 9 and 10, the coiling of the spring about 81*a* increases as the shade is pulled down. This decreases spring coiling about 80*a*. Conversely, the coiling of the spring about 80*a* increases as the shade is moved up. This decreases spring coiling about 81*a*. In this way, the spring acts as a force balancing device to maintain the shade at any selected elevation.

We claim:

1. A pleated shade assembly capable of height adjustment without use of pull cords, comprising, in combination:

a) an upper elongated support, b) a lower elongated member that is manually adjustable up and down, c) primary lines extending through shade pleats to suspend said bottom lower elongated member, d) primary rotors at said top upper elongated support to entrain said primary lines, e) a secondary line having endwise connection to said primary lines, at the same location whereby the secondary line defines a continuation of each primary line, f) and means acting on said secondary line for counterbalancing suspension force exerted on said primary lines at different shade height adjusted levels, g) said means including first and second rotary members entraining and exerting tensioning force on said secondary line, h) said means including a spring spirally coupled to said rotary members and exerting force tending to entrain said secondary line about said first and second rotary members, for storage on at least one of the first and second rotary members.

2. The combination of claim 1 wherein said spring has S-shaped configuration.

3. The combination of claim 1 wherein said spring winds in a clockwise direction about said first rotary member, and in a counterclockwise direction about said second rotary member.

4. The combination of claim 1 wherein said first rotary member has coaxial first and second surface portions, the spring winding about the first portion, and the secondary line winding about the second portion.

5. The combination of claim 4 wherein the first and second rotary members have coaxial first and second surface portions, the spring winding about the first portion and the secondary line or lines winding about the second portion.

6. The combination of claim 5 including a housing, and posts in the housing supporting the first and second rotary members for free rotation about axes defined by the posts.

7. A pleated shade assembly capable of height adjustment without use of pull cords, comprising, in combination:

a) an upper elongated support, b) a lower elongated member that is manually adjustable up and down, c) primary lines extending through shade pleats to suspend said lower elongated member, d) primary rotors at said upper elongated support to entrain said primary lines, e) a secondary line having endwise connection to said primary lines, f) and means acting on said secondary line for counterbalancing suspension force exerted on said primary lines at different shade height adjusted levels, g) said means including first and second rotary members exerting tensioning force on said secondary line, h) said means including a spring coupled to said first and second rotary members and exerting force tending to entrain said secondary line about said first and second rotary members, for storage on at least one of the members, i) each of the members having coaxial first and second surface portions, the spring winding about the first portion and the secondary line winding about the second portion, j) there being a housing, and posts in the housing supporting the first and second rotary members for free rotation about axes defined by the posts, k) and including annular caps associated with the posts and said first and second rotary members, for axially positioning said members in the housing.

8. The combination of claim 6 wherein the housing is defined by a portion of said upper elongated support which is a shade head rail.

9. A pleated shade assembly capable of height adjustment without use of pull cords, comprising, in combination:

a) an upper elongated support, b) a lower elongated member that is manually adjustable up and down, c) primary lines extending through shade pleats to suspend said lower elongated member, d) primary rotors at said upper elongated support to entrain said primary lines, e) a secondary line having endwise connection to said primary lines, f) and means acting on said secondary line for counterbalancing suspension force exerted on said primary lines at different shade height adjusted levels, g) said means including first and second rotary members exerting tensioning force on said secondary line, h) said means including a spring coupled to said first and second rotary members and exerting force tending to entrain said secondary line about said first and second rotary members, for storage on at least one of the members, i) and wherein said primary rotors include at least one second rotor over which said primary lines are entrained, and said primary rotors include a third rotor in the form of a pulley over which one of said primary lines is entrained, and a fourth rotor in the form of a pulley over which another of said primary lines is entrained.

10. The assembly of claim 9 wherein said upper elongated support protectively contains all of said primary rotors and said tensioning force exerting means.

11. The assembly of claim 1 wherein said primary lines have first terminals operatively connected to said lower elongated member, below said upper support.

12. A pleated shade assembly capable of height adjustment without use of pull cords, comprising, in combination:

a) an upper elongated support, b) a lower elongated member that is manually adjustable up and down, c) primary lines extending through shade pleats to suspend said lower elongated member, d) primary rotors at said upper elongated support to entrain said primary lines, e) a secondary line having operative connection to said primary lines, f) and means acting on said secondary line for counterbalancing suspension force exerted on said primary lines at different shade height adjusted levels, g) said means including first and second rotary members exerting tensioning force on said secondary line, h) said means including a spring coupled to said first and second rotary members and exerting force tending to entrain said secondary line about said first and second rotary members, for storage on at least one of the members, i) and including a guide rotor over which a section of said secondary line travels, said section located between said connection and said means, said guide rotor movable axially generally normal to said path of travel.

13. A collapsible shade assembly capable of height adjustment without use of pull cords, comprising, in combination:

a) an upper elongated support, b) a lower elongated member that is manually adjustable up and down, c) primary lines extending adjacent the shade to suspend said lower elongated member, d) primary rotors at said upper elongated support to entrain said primary lines, e) a secondary line having endwise connection to said primary lines, and at the same location whereby the secondary line defines a continuation of each primary line, f) and means acting on said secondary line for counterbalancing suspension force exerted one said primary lines at different shade height adjusted levels, said means including first and second rotary members entraining said secondary line, and a spring spirally connected to said first and second rotary members.

14. The combination of claim 13 wherein said spring has S-shaped configuration.

* * * * *